US009555925B2

(12) United States Patent
Marchek et al.

(10) Patent No.: US 9,555,925 B2
(45) Date of Patent: Jan. 31, 2017

(54) STACKING APPARATUS, STACKING SLEEVE, AND SLEEVE-PALLET

(71) Applicant: AFL Telecommunications LLC, Duncan, SC (US)

(72) Inventors: Kyle Joseph Marchek, Greer, SC (US); Abraham Israel Jimenez, Monterrey (MX)

(73) Assignee: AFL Telecommunications LLC, Duncan, SC (US)

( * ) Notice: Subject to any disclaimer, the term of this patent is extended or adjusted under 35 U.S.C. 154(b) by 0 days.

(21) Appl. No.: 14/386,026

(22) PCT Filed: Oct. 16, 2013

(86) PCT No.: PCT/US2013/065219

§ 371 (c)(1),
(2) Date: Sep. 18, 2014

(87) PCT Pub. No.: WO2014/062788

PCT Pub. Date: Apr. 24, 2014

(65) Prior Publication Data

US 2015/0027351 A1 Jan. 29, 2015

Related U.S. Application Data

(60) Provisional application No. 61/714,395, filed on Oct. 16, 2012.

(51) Int. Cl.
*B65D 21/02* (2006.01)
*B65D 19/06* (2006.01)
(Continued)

(52) U.S. Cl.
CPC ..... *B65D 21/0224* (2013.01); *B65D 19/06* (2013.01); *B65D 19/385* (2013.01); *B65D 85/02* (2013.01);
(Continued)

(58) Field of Classification Search
CPC ..... B65D 5/0065; B65D 19/20; B65D 2519/00019; B65D 2519/00029; B65D 19/385; B65D 85/02; B65D 2519/00273; B65D 2519/00293; B65D 2519/00323; B65D 21/0224; B65D 19/06; B65D 2519/00338; B65D 2519/00497
(Continued)

(56) References Cited

U.S. PATENT DOCUMENTS 3,294,306 A 12/1966 Areddy
4,413,737 A 11/1983 Wind
(Continued)

FOREIGN PATENT DOCUMENTS

FR 2788496 A1 7/2000
JP 61-3769 Y2 1/1986

OTHER PUBLICATIONS

International Search Report for PCT/US2013/065219 dated Mar. 10, 2014.
Written Opinion for PCT/US2013/065219 dated Mar. 10, 2014.

*Primary Examiner* — Chun Cheung
(74) *Attorney, Agent, or Firm* — Dority & Manning, P.A.

(57) ABSTRACT

A stacking apparatus including a stacking sleeve comprising walls and a top side, and a sleeve-pallet comprising a platform configured to support goods. The stacking sleeve being configured to surround goods on a first sleeve-pallet and support a second sleeve-pallet on the top side. The stacking sleeve may further comprise braces and access holes. The stacking sleeve may be configured to enable nesting of a second sleeve-pallet supported by the stacking sleeve. The platform of the sleeve-pallet may be further configured to support a stacking sleeve. The sleeve-pallet may further comprise a securing structure to secure a stacking sleeve supported by the platform. The platform of the
(Continued)

sleeve-pallet may be further configured to nest in a stacking sleeve.

12 Claims, 7 Drawing Sheets

(51) Int. Cl.
*B65D 19/38* (2006.01)
*B65D 85/02* (2006.01)

(52) U.S. Cl.
CPC ..... *B65D 2519/0097* (2013.01); *B65D 2519/00273* (2013.01); *B65D 2519/00293* (2013.01); *B65D 2519/00323* (2013.01); *B65D 2519/00338* (2013.01); *B65D 2519/00497* (2013.01); *B65D 2519/00621* (2013.01); *B65D 2519/00641* (2013.01); *B65D 2519/00676* (2013.01)

(58) Field of Classification Search
USPC ..... 206/386–600; 229/122.21
See application file for complete search history.

(56) References Cited

U.S. PATENT DOCUMENTS 4,660,724 A * 4/1987 Gaynes ..... B65D 25/24 206/509
5,036,979 A * 8/1991 Selz ..... B65D 19/20 206/386
5,429,261 A * 7/1995 Machino ..... B65D 11/184 220/4.28
2005/0199623 A1 9/2005 Elder et al.

* cited by examiner

STACKING APPARATUS, STACKING SLEEVE, AND SLEEVE-PALLET

CROSS-REFERENCE TO RELATED APPLICATIONS

This application is based upon and claims the benefit of priority from U.S. Provisional Application No. 61/714,395, filed Oct. 16, 2012, in the United States Patent and Trademark Office, the disclosures of which are incorporated herein in its entirety by reference.

BACKGROUND

1. Field

The Application is related to packaging, and more particularly to stacking and storage of goods on platforms.

2. Related Art

One of the key challenges in storing or transporting of certain goods is the inability to stack pallets of the goods. This can arise for a number of reasons, such as an irregular shape or delicate materials. In the existing art, for instance, only one reel is typically placed on a wooden pallet for transport as they are generally non-stackable. This creates a waste of space during the shipment process.

The present exemplary embodiment provides a logical means for stacking multiple pallets of goods.

SUMMARY

Exemplary embodiments of the present invention may address the problems and/or disadvantages of the current technology/methodology described above. Although an embodiment is not required to overcome all of the disadvantages described above, an exemplary embodiment of the present invention may address the above disadvantages, and further disadvantages not described above, or may not overcome any of the problems listed above while still providing improved methodology and enhancement to the present art.

One exemplary embodiment of the present invention is a stacking apparatus with at least one stacking sleeves and at least one portable platforms. When desiring to stack multiple platforms, each supporting goods, a stacking sleeve may be placed around a first set of goods on a first platform, and a second platform, supporting a second set of goods, may be placed on top of the first set of goods and the stacking sleeve, supported by the stacking sleeve Other features of the embodiment may include braces with or on at least one stacking sleeve, which may be designed to support the second platform. Other features may include at least one stacking sleeve being able to nest the second platform in the upper end of the stacking sleeve. Other features may include one or more openings in at least one stacking sleeve. The openings may to allow access to one or more of the first and second platforms, such as by a forklift. Other features may include at least one stacking sleeve being made of a corrugated material. Other features may include at least one stacking sleeve being made of a pierceable material so that the stacking sleeve may be connected to the platforms through staples, nails, screws, or the like. Other features may include at least one stacking sleeve being made to be supported by the first platform.

Other features of the embodiment may include at least one of the portable platforms being a sleeve-pallet. Other features may include at least one sleeve-pallet having a length and a width that enable the sleeve-pallet to nest in a stacking sleeve. Other features may include the at least one sleeve-pallet being able to support a stacking sleeve. Other features may include the at least one sleeve-pallet having a securing structure for securing a stacking sleeve being supported by the sleeve-pallet. The securing structure of the at least one sleeve-pallet may be one or more stringers made to brace against the walls of a stacking sleeve being supported by the sleeve-pallet.

DETAILED DESCRIPTION

The following detailed description is provided to assist the reader in gaining a comprehensive understanding of the methods, apparatuses and/or systems described herein. Various changes, modifications, and equivalents of the systems, apparatuses and/or methods described herein will suggest themselves to those of ordinary skill in the art. Descriptions of well-known functions and structures are omitted to enhance clarity and conciseness. Similar numbering is used throughout in reference to similar structure.

Figure 1:
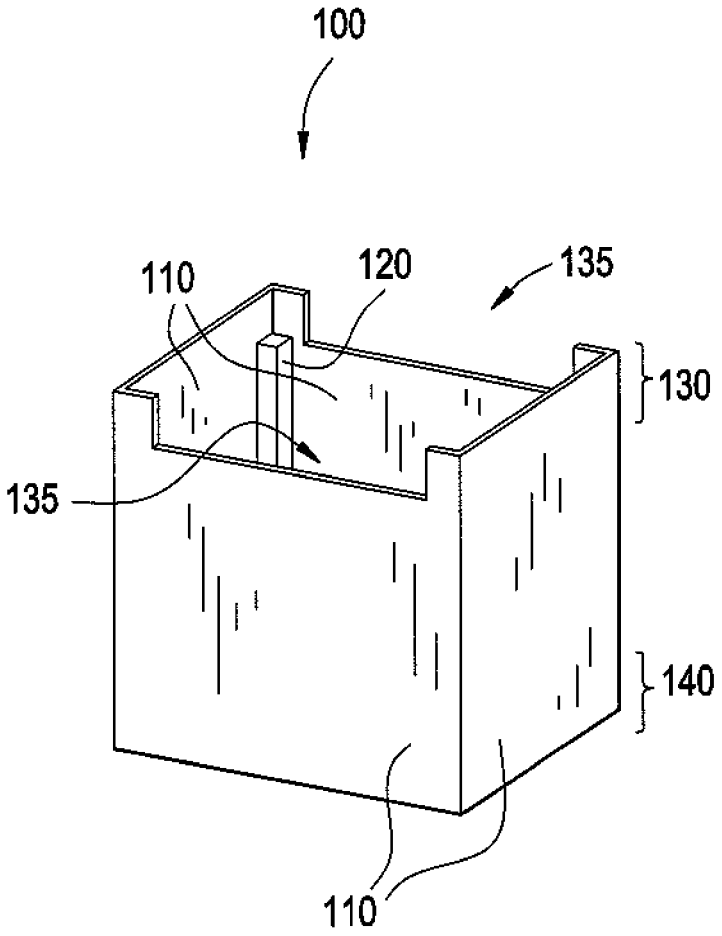
FIG. 1 shows a perspective view of an exemplary embodiment of a stacking sleeve.

FIG. 1 shows a perspective view of an exemplary embodiment of a stacking sleeve 100. Some of the major components are identified. The stacking sleeve 100 includes walls 110, a brace 120, an upper end 130 having holes 135, and a lower end 140. The stacking sleeve 100 has been designed so that it may envelop goods (not shown) on a first platform (not shown), and support a second platform (not shown) placed on the upper end 130 of the stacking sleeve 100 (See FIGS. 6A-6C). Goods may include, but are not limited to, reels, spools, equipment, inventory, supplies, chattel, or other items that may be stored or shipped on a shipping platform. Also, the brace 120 are configured to support the second platform. Although only one brace 120 is shown, a plurality of braces may be used and configured to support the second platform. Also, the holes 135 are configured to allow access to the second platform, such as by a forklift (not shown). The walls 110 of the stacking sleeve 100 may be of corrugated materials. The walls 110 may also be made of a pierceable material so that the stacking sleeve 100 may be secured to the first or second platform by nails, staples, or the like (not shown). Also, the stacking sleeve 100 may be secured to the first or second platforms with banding material (not shown).

Figure 2:
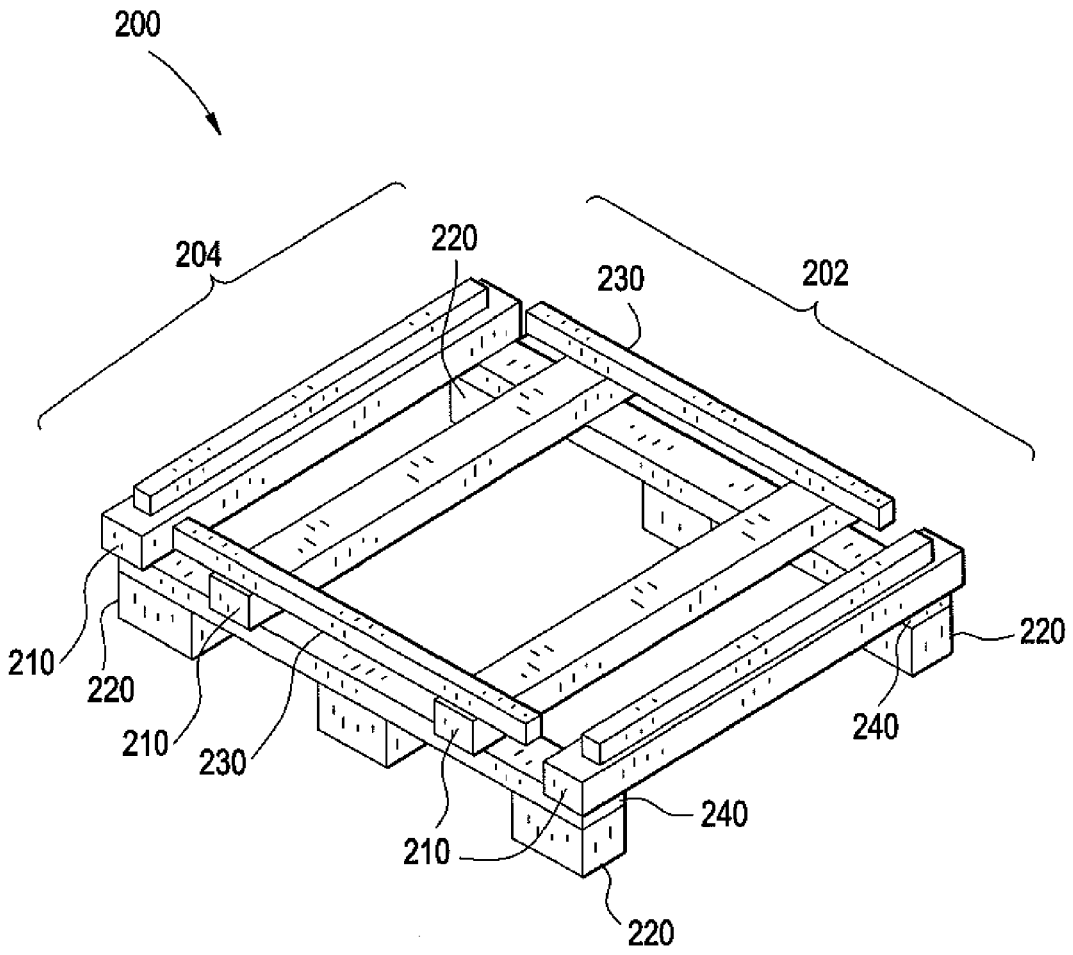
FIG. 2 shows a perspective view of an exemplary embodiment of a sleeve-pallet.

FIG. 2 shows a perspective view of an exemplary embodiment of sleeve-pallet 200. The sleeve-pallet 200 includes deckboards 210, feet 220, lower stringers 240, and upper stringers 230. The upper stringers 230 are configured to secure the lower end 140 of a stacking sleeve 100 (not shown) (see FIG. 3). The sleeve-pallet 200 has a length 202 and a width 204. The length 202 and width 204 are such that the sleeve-pallet 200 can nest in the upper end 130 of a stacking sleeve 100 (not shown) (See FIG. 4).

Figure 3:
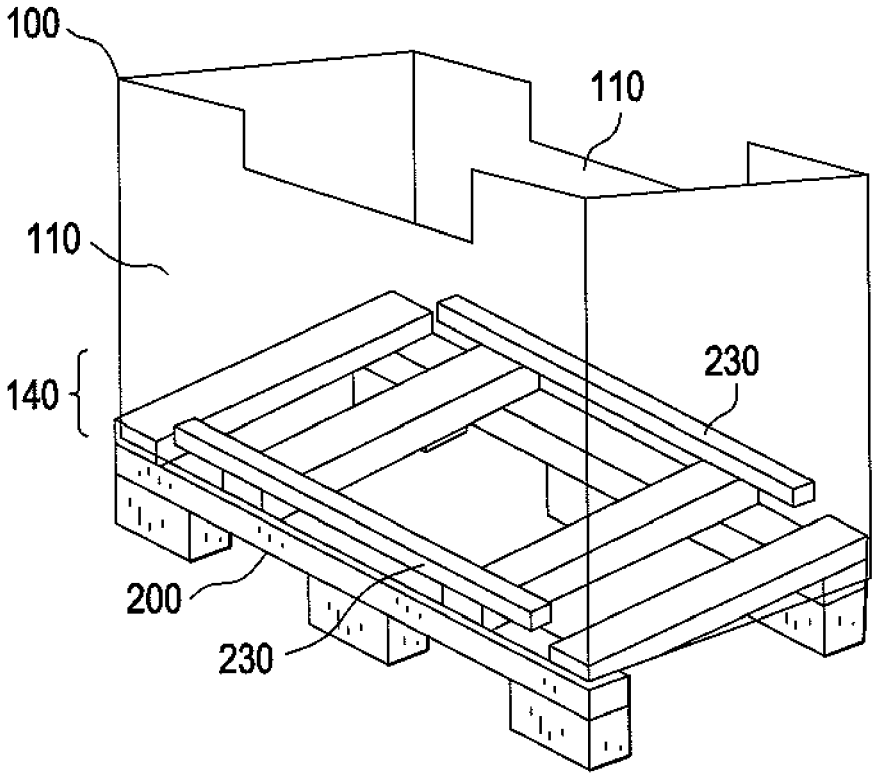
FIG. 3 shows perspective view of a see-through stacking sleeve resting on a pallet.

FIG. 3 shows the outline of an exemplary embodiment of a stacking sleeve 100 resting on an exemplary embodiment of a sleeve-pallet 200. The upper stringers 230 of the sleeve-pallet 200 secure the lower end 140 of the stacking sleeve 100 by bracing against the walls 110 of the stacking sleeve 100. Although in the exemplary embodiment, the stacking sleeve 100 is secured using upper stringers 230, the securing method of an embodiment is not limited to the use of upper stringers 230. As a non-limiting example, the lower end 140 of the stacking sleeve 100 could be secured in grooves on the sleeve-pallet 200.

Figure 4:
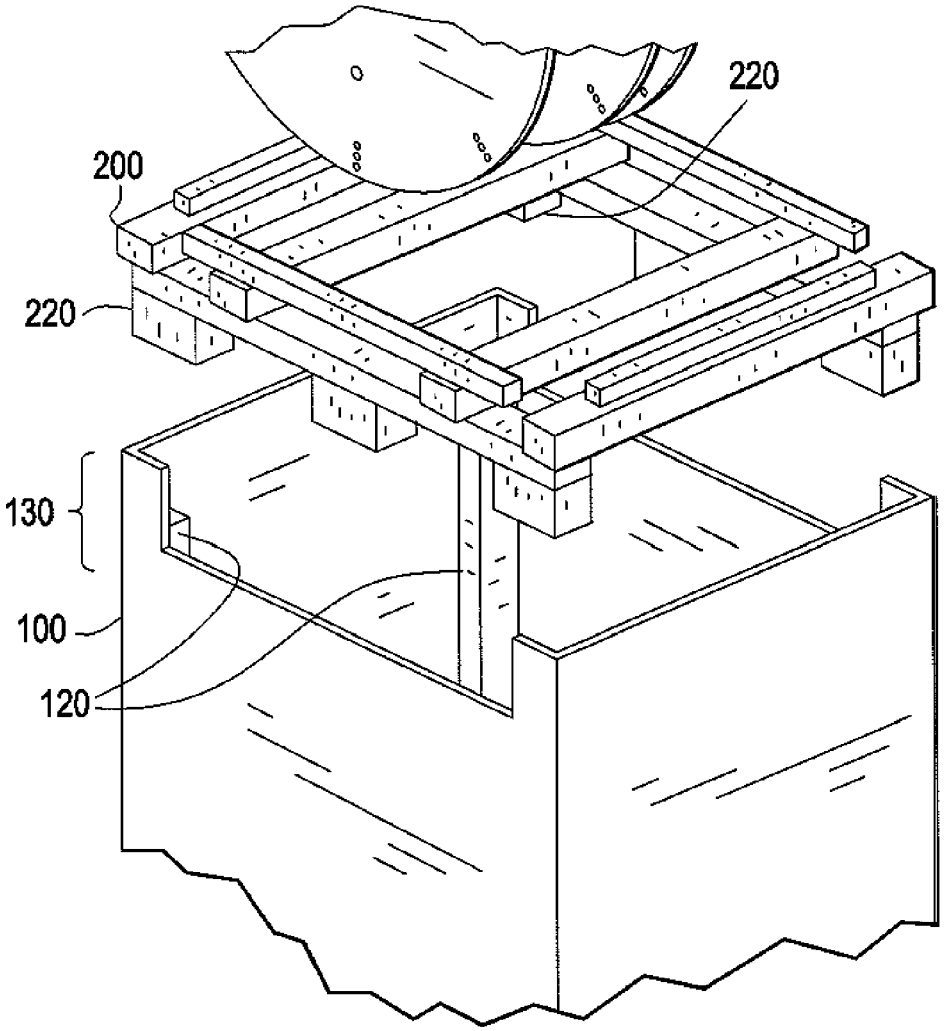
FIG. 4 shows a perspective of an exemplary embodiment of a stacking sleeve with a pallet being placed on top of the stacking sleeve.

FIG. 4 shows a perspective view of an exemplary embodiment of a sleeve-pallet 200 and an exemplary embodiment of a stacking sleeve 100. The feet 220 of the sleeve-pallet 200 are placed on the braces 120 of the stacking sleeve 100, causing the sleeve-pallet 200 to nest in upper end 130 of the stacking sleeve 100. Although this method is used in the present embodiment, other methods may be used for the nesting function of an embodiment of a sleeve-pallet. As a non-limiting example, the feet 220 of a sleeve-pallet 200 may be placed on the outside of the stacking sleeve 100.

Figure 5A:
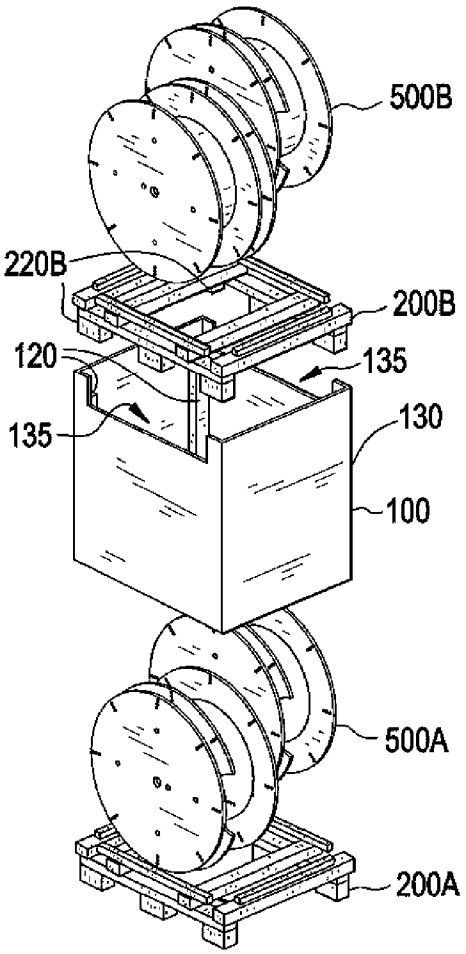
FIGS. 5A-5C shows the process of stacking multiple pallets utilizing a stacking sleeve.

FIG. 5A shows a perspective view of a method of use of an exemplary embodiment of a stacking sleeve 100 with exemplary embodiments of a lower sleeve-pallet 200A and an upper sleeve-pallet 200B. The lower sleeve-pallet 200A is placed down. A first set of goods 500A is placed on the lower sleeve-pallet 200A. The stacking sleeve 100 is placed around the first set of goods 500A on the lower sleeve-pallet 200A. The upper sleeve-pallet 200B is nested into the stacking sleeve 100. The feet 220B of the upper sleeve-pallet 200B rest on the braces 120 of the stacking sleeve 100. A second set of goods 500B is placed on the upper sleeve-pallet 200B, either before or after the upper sleeve-pallet 200B is nested. Holes 135 in the upper end 130 of the stacking sleeve 100 provide access to the upper sleeve-pallet 200B. Although only an upper sleeve-pallet 200B, a lower sleeve-pallet 200A, and one stacking sleeve 100 are used, additional sleeve-pallets (not shown) may be stacked utilizing additional stacking sleeves (not shown). Although the FIG. 5A utilizes sleeve-pallets 200A and 200B, other platforms (not shown) may be used with the stacking sleeve 100.

Figure 5B:
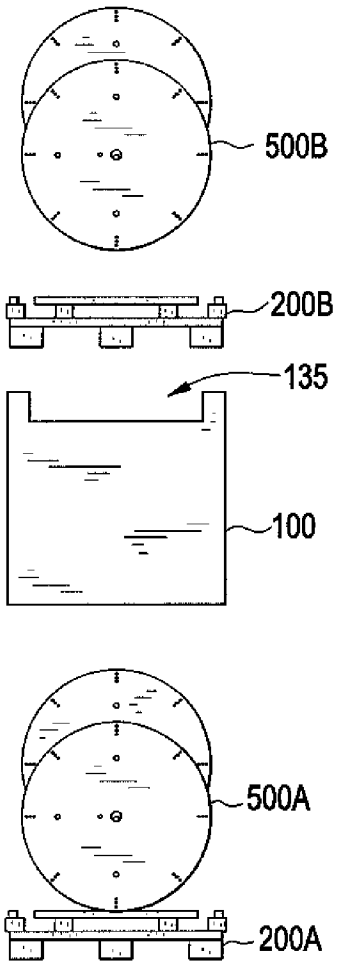

FIG. 5B shows the method of use of FIG. 5A, only from an orthogonal side view. A first set of goods 500A is placed on a lower sleeve-pallet 200A. A stacking sleeve 100 is placed around the first set of goods 500A. An upper sleeve-pallet 200B is placed on the stacking sleeve 100. A second set of goods 500B is placed on the upper sleeve-pallet 200B. A hole 135 in the stacking sleeve 100 provides access to the upper sleeve-pallet 200B.

Figure 5C:
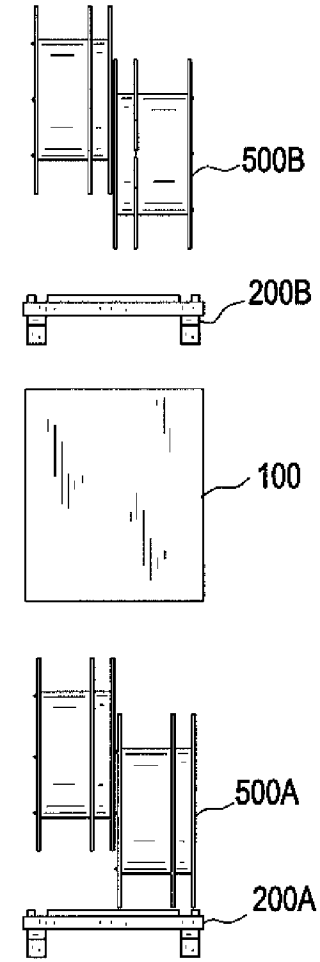

FIG. 5C shows the method of use of FIG. 5A, only from an orthogonal view from the front. A first set of goods 500A is placed on a lower sleeve-pallet 200A. A stacking sleeve 100 is placed around the first set of goods 500A. An upper sleeve-pallet 200B is placed on the stacking sleeve 100. A second set of goods 500B is placed on the upper sleeve-pallet 200B.

Figure 6A:
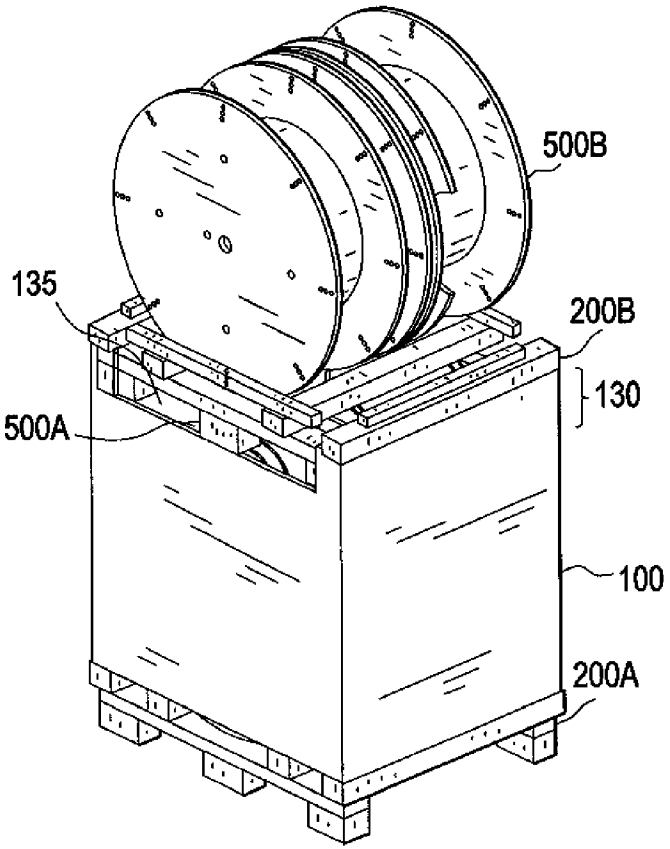
FIGS. 6A-6C show various views of pallets stacked using a stacking sleeve.

FIG. 6A shows a perspective view of an exemplary embodiment of a stacking sleeve 100 being used with an exemplary embodiment of an upper sleeve-pallet 200B and an exemplary embodiment of a lower sleeve-pallet 200A. Goods 500A rest on both the lower sleeve-pallet 200A, and goods 500B rest on the upper sleeve-pallet 200B. The stacking sleeve 100 surrounds the goods 500A on the lower sleeve-pallet 200A. The upper sleeve-pallet 200B is nested in the upper end 130 of the stacking sleeve 100. The upper sleeve-pallet 200B is supported by the stacking sleeve 100. A hole 135 in the stacking sleeve 100 allows access to the upper sleeve-pallet 200B.

Figure 6B:
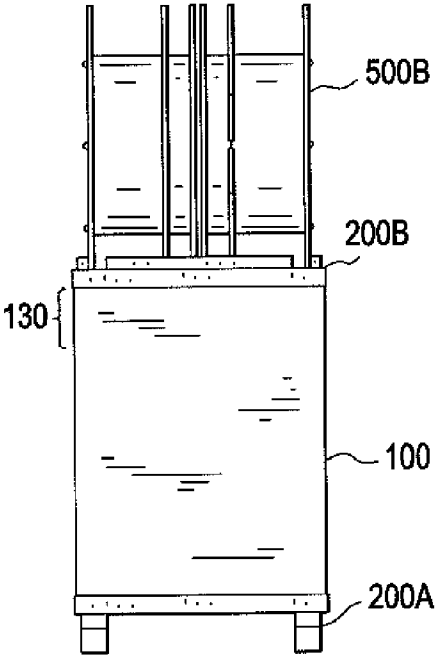

FIG. 6B shows the use of FIG. 6A, only from an orthogonal frontal view. The stacking sleeve 100 surrounds the goods (not shown) on the lower sleeve-pallet 200A. The upper sleeve-pallet 200B is nested in the upper end 130 of the stacking sleeve 100. The upper sleeve-pallet 200B is supported by the stacking sleeve 100. Goods 500B rest on the upper sleeve-pallet 200B.

Figure 6C:
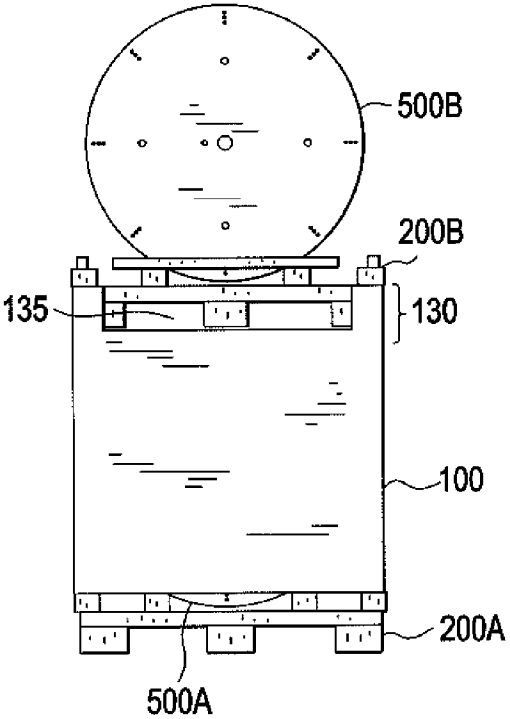

FIG. 6C shows the use of FIG. 6A, only from an orthogonal side view. Goods 500A rest on both the lower sleeve-pallet 200A, and goods 500B rest on the upper sleeve-pallet 200B. The stacking sleeve 100 surrounds the goods 500A on the lower sleeve-pallet 200A. The upper sleeve-pallet 200B is nested in the upper end 130 of the stacking sleeve 100. The upper sleeve-pallet 200B is supported by the stacking sleeve 100. The hole 135 in the stacking sleeve 100 allows access to the upper sleeve-pallet 200B.

Figure 7:
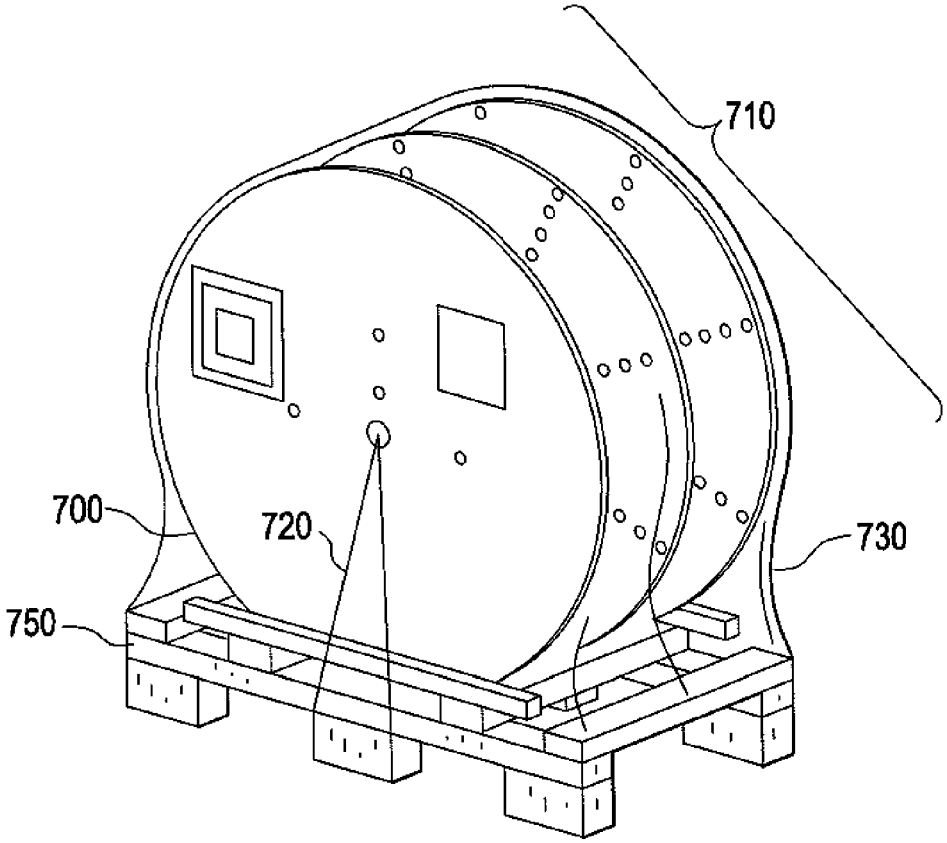
FIG. 7 shows a perspective view of the traditional means for shipping reels.

FIG. 7 shows a traditional means of shipping reels 700. Reels 700 are placed on a pallet 750. A band 720 is laced through the reels 700. Stretch wrap 730 is placed around the reels 700. The rounded edge 710 of the reels 700 makes stacking difficult, and therefore, multiple pallets 750 of reels 700 are not stacked.

Advantages and benefits of an exemplary embodiment may include, but are not limited to, the following:

1. New design allows for the stacking of platforms for irregularly shaped and delicate goods.
2. New design secures stacked platforms by enabling nesting.
3. New design gives access to platforms directly by including holes in sleeve walls.
4. New design uses corrugated materials.
5. New design uses pierceable materials.
6. New design braces to support a platform.
7. New design secures the lower end of a stacking sleeve.

As mentioned above, although the exemplary embodiments described above are various stacking sleeves and sleeve-pallets the general inventive concept should not be limited thereto, and it could also apply to other types of embodiments.

The invention claimed is:

1. A stacking apparatus comprising:
one or more stacking sleeves; and
one or more portable platforms,
wherein at least one stacking sleeve comprises
one or more walls configured to define a hollow middle volume;
an upper end;
a lower end;
a top side;
a bottom side; and
one or more braces extending in a first direction from the lower end toward the upper end,
wherein the bottom side comprises a bottom opening,
wherein the middle volume and the bottom opening are configured to envelope goods on a first portable platform,
wherein the stacking sleeve is configured to support a second portable platform,
wherein the one or more braces are configured to support the second portable platform when rested on the top side, and
wherein the one or more walls extend beyond the one or more braces at the upper end in the first direction, wherein the upper end of the at least one stacking sleeve comprises one or more holes, wherein the one or more holes of the upper end of the at least one stacking sleeve are configured to allow access to the second portable platform.

2. The stacking apparatus of claim 1, wherein at least one of the portable platforms is a sleeve-pallet comprising a platform configured to support goods, the platform comprising a length and a width, wherein the platform length and width are configured so that the sleeve-pallet is capable of nesting in a stacking sleeve.

3. The stacking apparatus of claim 2, wherein the platform of the at least one sleeve-pallet is further configured to support a stacking sleeve, and wherein the sleeve-pallet further comprises a securing structure for securing a stacking sleeve supported by the platform.

4. The stacking apparatus of claim 3, wherein the securing structure of the at least one sleeve-pallet comprises one or more stringers configured to brace against walls of a stacking sleeve supported by the platform.

5. The stacking apparatus of claim 1, wherein at least one of the portable platforms is a sleeve-pallet comprising a platform configured to support goods and a stacking sleeve; and a securing structure configured to secure a stacking sleeve supported by the sleeve-pallet.

6. The stacking apparatus of claim 5, wherein the securing structure of the at least one sleeve-pallet comprises one or more stringers configured brace against walls of a stacking sleeve supported by the platform.

7. The stacking apparatus of claim 1, wherein the upper end of the at least one stacking sleeve is configured to nest the second portable platform when rested on the top side.

8. The stacking apparatus of claim 1, wherein the one or more walls of the at least one stacking sleeve comprise a corrugated material.

9. The stacking apparatus of claim 1, wherein the one or more walls of the at least one stacking sleeve comprise a pierceable material.

10. The stacking apparatus of claim 1, wherein the lower end of the at least one stacking sleeve is configured to rest on the first portable platform.

11. The stacking apparatus of claim 1, wherein the first portable platform comprises a securing structure including one or more stringers configured to brace against walls of a stacking sleeve supported by the first platform.

12. The stacking apparatus of claim 11, wherein the securing structure comprises a first stringer and a second stringer configured to brace against two opposite side walls of the stacking sleeve supported by the first platform.

* * * * *